United States Patent [19]

Hayami et al.

[11] Patent Number: 4,859,251

[45] Date of Patent: Aug. 22, 1989

[54] FURNACE FOR FORMATION OF BLACK OXIDE FILM ON THE SURFACE OF THIN METAL SHEET AND METHOD FOR FORMATION OF BLACK OXIDE FILM ON THE SURFACE OF SHADOW MASK MATERIAL BY USE OF SAID FURNACE

[75] Inventors: Toshitomo Hayami, Himeji; Humio Shibata, Hyogo; Katsumi Iguchi, Ttsuno; Hisao Inoue, Nagoya; Takashi Ono, Okazaki; Takashi Ishimoto, Aichi, all of Japan

[73] Assignee: Kabushiki Kaisha Toshiba, Kanagawa, Japan

[21] Appl. No.: 164,484

[22] Filed: Mar. 4, 1988

[30] Foreign Application Priority Data

Mar. 7, 1987 [JP] Japan ..... 62-52359

[51] Int. Cl.[4] ..... C23C 8/18

[52] U.S. Cl. ..... 148/286

[58] Field of Search ..... 148/6.35

[56] References Cited

U.S. PATENT DOCUMENTS

| | | | |
|---|---|---|---|
| 3,708,351 | 1/1973 | Dallas | 148/6.35 |
| 3,795,542 | 3/1974 | Halaby | 148/6.35 |
| 4,035,200 | 7/1977 | Valeutiger | 148/6.35 |
| 4,448,612 | 5/1984 | Ebert | 148/6.35 |
| 4,714,497 | 12/1982 | Poncet | 148/6.35 |

FOREIGN PATENT DOCUMENTS

| | | | |
|---|---|---|---|
| 45-19764 | 7/1970 | Japan | 148/6.35 |

OTHER PUBLICATIONS

Japanese Patent Disclosure No. 59-149636, Ueda et al., Aug. 27, 1984.

Japanese Patent Disclosure No. 60-194059, Suzuki et al., Oct. 2, 1985.

*Primary Examiner*—Sam Silverberg

*Attorney, Agent, or Firm*—Finnegan, Henderson, Farabow, Garrett, & Dunner

[57] ABSTRACT

A furnace for the formation of a black oxide film on the surface of a thin metal sheet is disclosed which comprises a tunnel-like furnace proper provided at one terminal side thereof with an inlet and at the other terminal side thereof with an outlet, conveying means laid inside the furnace proper from the inlet through the outlet thereof for conveying a thin metal sheet from the inlet to the outlet, openable shutter means for partitioning the interior of the furnace proper into at least first and second regions on the front and rear sides respectively in the direction of conveyance of the thin metal sheet, first gas supply means for feeding into the first region on the inlet side of the furnace proper partitioned by the shutter means a mixed gas containing carbon dioxide and carbon monoxide and containing substantially no oxygen or a mixed gas containing carbon dioxide, carbon monoxide, and steam and containing substantially no oxygen, second gas supply means for feeding into the second region on the outlet side of the furnace proper partitioned by the shutter means a mixed gas containing carbon dioxide, carbon monoxide, and oxygen and containing substantially no steam, and heating means for heating the first region to a temperature in the range of 500° to 650° C. and the second region to a temperature in the range of 100° to 300° C.

3 Claims, 3 Drawing Sheets

FURNACE FOR FORMATION OF BLACK OXIDE FILM ON THE SURFACE OF THIN METAL SHEET AND METHOD FOR FORMATION OF BLACK OXIDE FILM ON THE SURFACE OF SHADOW MASK MATERIAL BY USE OF SAID FURNACE

The present application claims priority of Japanese Patent Application No. 62-52359 filed on Mar. 7, 1987, and No. 63-42967 filed on Feb. 25, 1988.

FIELD OF THE INVENTION AND RELATED ART STATEMENT

This invention relates to a treatment for the formation of a black oxide film on the surface of a thin metal sheet and more particularly to a furnace to be used in actually carrying out the treatment for the formation of the black oxide film and a method for the formation of the black oxide film on the surface of a shadow mask by the use of the furnace mentioned above.

Heretofore, the shadow mask within a color picture tube has been produced by using a low-carbon steel of high purity such as, for example, rimmed steel or aluminum-killed steel as a material.

Then, the practice of forming a black oxide ($Fe_3O_4$) film of close texture and high adhesiveness on the surface of a thin metal sheet destined to constitute itself a shadow mask has been in vogue.

The formation of the black oxide film on the surface of the thin metal sheet in the manner described above is aimed at preventing the thin metal sheet from occuring red rust ($\alpha$-$Fe_2O_3$) under various heat treatments during the processes color picture tube production, preventing the thin metal sheet from scattering electron beams, imparting an improved heat radiating property to the thin metal sheet, abating discharge of secondary electrons, and preventing the inner surface of a braun tube from scattering ultraviolet light during the course of formation of carbon on the inner surface by photolithography.

As means of formation of carbon layer absorbing ambient lights on the inner surface of panel by a thin metal sheet destined to constitute itself a shadow mask, generally the following methods have been known to the art.

A method is disclosed (Japanese Patent Application Disclosure SHO 54(1979)-139,463) which comprises first subjecting a shadow mask material to a blackening treatment in a mixed gas atmosphere of nitrogen, carbon dioxide, and steam at a temperature in the range of 550° to 600° C.

Another method is disclosed (Japanese Patent Application Disclosure No. SHO 57(1982)-57,448) which comprises first subjecting a shadow mask material to a blackening treatment in a mixed gas atmosphere of nitrogen and steam or a mixed gas atmosphere of nitrogen and carbon dioxide and then subjecting the same material to a blackening treatment in a mixed gas atmosphere of nitrogen, carbon dioxide, and oxygen.

Still another method is disclosed (Japanese Patent Application Disclosure No. SHO 57(1982)-121,128) which comprises joining a shadow mask material and a frame and then subjecting the resultant assembly to a blackening treatment in a mixed gas atmosphere of nitrogen, oxygen, and carbon monoxide.

Incidentally, efforts are being directed toward shortening the pitch of holes for passage of electron beams for the purpose of improving the resolution of images for display.

In the whole amount of electron beams issued from an electron gun, the portion in the range of 15 to 20% is allowed to pass through the holes for passage of electron beams and collide against phosphor layers and the remainder to collide against the shadow mask and consequently induce inevitable elevation of the temperature of the shadow mask itself. As a result, the shadow mask is suffered to deform so much by thermal expansion as to disrupt the positional relation between the holes for passage of electron beams which ought to fall on the paths of electron beams and the phosphor layers. In the shadow mask in which the holes for passage of electron beams are separated by a smaller pitch, therefore, the portion of electron beams which pass the holes for passage of electron beams but fail to hit the phosphor layers of desired colors is so large as to induce misalignment of colors, a phenomenon fatal to a color TV receiver, as compared with the shadow mask having such holes separated by a larger pitch.

This situation has been encouraging growing adoption of Invar alloy, a material of low thermal expansion using Fe and Ni as main components, as a material for the shadow mask in the place of a low-carbon steel of high purity such as rimmed steel or aluminum-killed steel.

The practice of forming a black oxide film using $Fe_3O_4$ as a main component thereof on the surface of the shadow mask material produced of this Invar alloy is already in vogue.

In the formation of the black oxide film on the surface of a shadow mask material made of this Invar alloy, since the Invar alloy possesses outstanding corrosion-proofness owing to the presence of Ni therein, the treatment for oxidation must be carried out within a furnace designed to operate under specific conditions.

There is, for example, a method which uses a furnace constructed after the pattern of a continuous kiln and, inside this furnace, heats a shadow mask material in a mixed gas atmosphere of carbon dioxide and carbon monoxide to a temperature of about 580° C. This method enables the oxidation of the surface of the material under treatment to proceed evenly and, owing to the construction of the furnace resembling that of a continuous kiln, permits the formation of the black oxide film on the surface of the material to take place with high efficiency. It nevertheless has a disadvantage that the black oxide film cannot be produced in a sufficient thickness.

There is another method which uses a furnace constructed after the pattern of a batch furnace and, inside this furnace, heats a shadow mask material in an atmosphere of steam or air at temperatures of 500° to 750° C. while controlling the amount of steam stepwise. It is famed to permit formation of a black oxide film of sufficient thickness on the surface of a shadow mask material. This method, however, suffers from poor productivity because it requires to use a batch type furnace. Moreover, the black oxide film formed on the surface of the shadow mask material lacks consistency in thickness in the sense that when a multiplicity of shadow mask materials are placed in the furnace as piled up in a plurality of stages, the films formed on the materials placed in the upper stages have a different thickness from those on the materials placed in the lower stages and the films formed on the materials placed along the peripheral region on the furnace interior have a different thickness from those on the materials placed in the central region. This method has a further disadvantage that the black oxide films have the quality thereof dispersed among different lots of operation.

There is still another method which, as disclosed in Japanese Patent Application Disclosures Nos. SHO 59(1984)-56,345, SHO 59(1984)-149,635, and SHO 59(1984)-149,636, comprises imparting a Fe-enriched surface to a shadow mask material as by electropolishing, chemical treatment, or Fe plating before the shadow mask material is subjected to a blackening treatment. This method, however, has a disadvantage that it entails an addition to the number of steps of operation and a consequent inevitable increase in production cost.

OBJECT AND SUMMARY OF THE INVENTION

It is, therefore, an object of this invention to provide a furnace which permits a black oxide film of sufficient and uniform thickness to be formed with high productional efficiency on the surface of a thin metal sheet.

A further object of this invention is to provide a furnace with permits a black oxide film enjoying high density and adhesiveness and excelling in degree of blackness to be formed on the surface of a thin metal sheet.

Another object of this invention is to provide a furnace which permits a black oxide film of sufficient and uniform thickness to be formed with high productional efficiency on the surface of a thin metal sheet made of Invar alloy.

Still another object of this invention is to provide a method which permits a black oxide film of sufficient and uniform thickness to be formed with high productional efficiency on the surface of a shadow mask material made of Invar alloy.

A further object of this invention is to provide a method which produces a shadow mask exhibiting a high thermal emissivity and possessing high functional stability by forming a black oxide film of high quality on the surface of a shadow mask material made of Invar alloy.

Yet another object of this invention is to provide a method which permits a reduction in production cost by improving the yeild of production of shadow masks having a black oxide film on the surface of a shadow mask material.

To accomplish the objects described above, the present invention contemplates a furnace for the formation of a black oxide film on the surface of a thin metal sheet, which comprises a tunnel-like furnace proper provided at one terminal side thereof with an inlet and at the other terminal side thereof with an outlet, conveying means laid inside the furnace proper from the inlet through the outlet thereof and adapted to convey a thin metal sheet from the inlet to the outlet, openable shutter means for partitioning the interior of the furnace proper into at least first and second regions on the front and rear sides respectively in the direction of conveyance of the thin metal sheet, first gas supply means for feeding into the first region on the inlet side of the furnace proper partitioned by the shutter means a mixed gas containing carbon dioxide, carbon monoxide, and steam and containing substantially no oxygen, second gas supply means for feeding into the second region on the outlet side of the furnace proper partitioned by the shutter means a mixed gas containing carbon dioxide, carbon monoxide, and oxygen and containing substantially no steam, and heating means for heating the first region to a temperature in the range of 500° to 650° C. and the second region to a temperature in the range of 100° to 300° C.

DETAILED DESCRIPTION OF PREFERRED EMBODIMENTS

Now, preferred embodiments of this invention will be described below with reference to the accompanying drawings.

Figure 1:
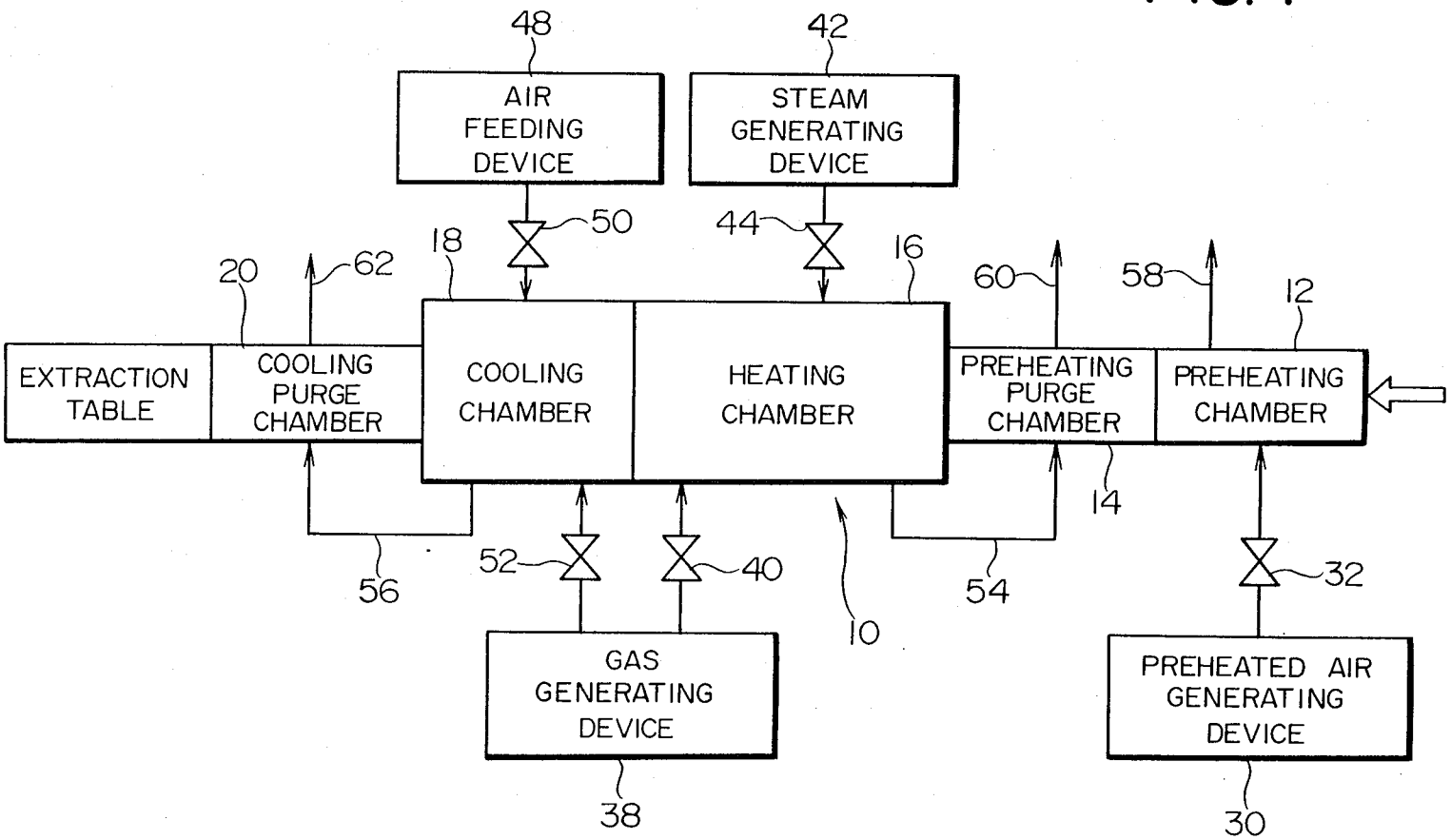
FIG. 1 is a block diagram illustrating the construction of a typical furnace embodying the present invention.
Figure 2:
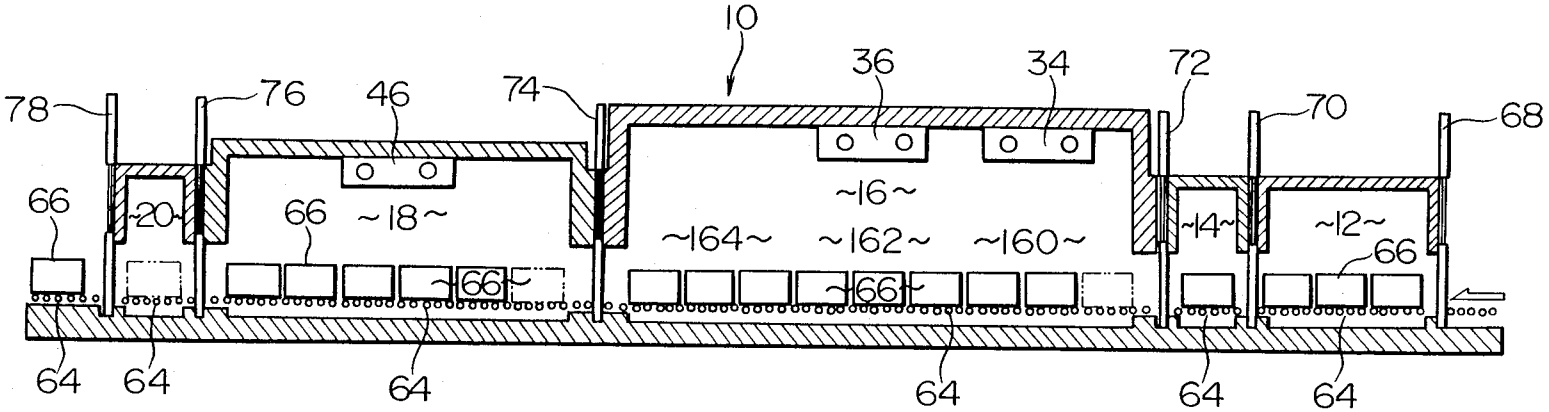
FIG. 2 is a cross section of the furnace of FIG. 1.

In the embodiment illustrated in FIG. 1 and FIG. 2, a furnace proper 10 is provided along the direction of conveyance of a material under treatment (shadow mask material) indicated by an arrow with a preheating chamber 12, a preheating purge 14, a heating chamber 16, a cooling chamber 18, and a cooling purge chamber 20.

The preheating chamber 12 is a room for preheating the material under treatment (shadow mask material) to a prescribed temperature. This preheating chamber 12 is adapted to introduce therein through a control valve 32 the preheated air which is produced in a preheated air generating device 30.

The heating chamber 16 has the interior thereof divided into three zones, i.e. a first heating zone 160, a second heating zone 162, and an igniting zone 164. The ceiling part or floor part of the heating chamber corresponding to the first heating zone 160 and the second heating zone 162 are jointly provided with heating means using tube burners adapted to generate heat by the combustion of natural gas, for example. These heating devices are given required control by respective heat controlling devices which are not shown in the diagram. This heating chamber 16 is further adapted to admit therein through a control valve 40 a mixed gas of $CO_2$ and CO produced by a gas generating device 38. The heating chamber 16 is further adapted to permit introduction therein through a control valve 44 the steam produced by a steam generating device 42.

The cooling chamber 18 is provided in the ceiling part or floor part thereof with a heating device 46 using a tube burner for setting room temperature conditions enough to cool to a desired temperature the material heated in the heating chamber 16. This heating device 46 is given required control by a heat controlling device which is not shown in the diagram. This cooling chamber 18 is adapted to admit therein through a control valve 50 the air prepared in an air feeding device 48. This cooling chamber 18 is further adapted to introduce therein through a control valve 52 a mixed gas of $CO_2$ and CO emanating from the aforementioned gas generating device 38.

The preheating purge chamber 14 and the heating chamber 16 are interconnected outside the furnace proper 10 through the medium of a pipe 54. This connection permits the interior gas of the heating chamber 16 to be introduced into the preheating purge chamber 14. The cooling purge chamber 20 and the cooling chamber 18 are likewise interconnected outside the furnace proper 10 through the medium of a pipe 56. This connection permits the interior gas of the cooling chamber 18 to be introduced into the cooling purge chamber 20.

The preheating chamber 12, the preheating purge chamber 14, and the cooling purge chamber 20 are jointly provided with a piping such that the preheated air and the mixed gas introduced into these chambers will be discharged respectively via waste gas bypasses 58, 60, and 62 into a waste gas storage tank (not shown) installed outside.

Figure 3:
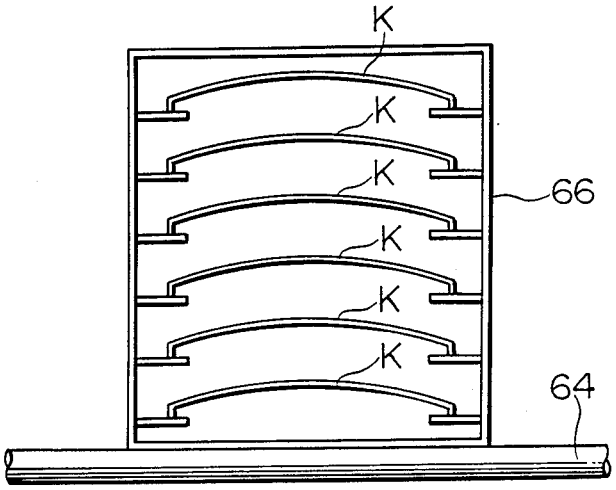
FIG. 3 is a side view illustrating a contrainer holding a plurality of shadow mask materials and conveyed through the interior of the furnace.

The furnace proper 10 is provided in the interior thereof with a roller conveyor 64 serving to convey a material under treatment from the inlet through the outlet of the furnace. This roller conveyor 64 is provided with independent drive systems adapted to be operated independently in the individual chambers.

Where this furnace is used for the formation of a black oxide film on the surface of a thin metal sheet, a plurality of materials (shadow mask materials) K are subjected to the treatment as held vertically spaced inside a container 66 resembling a case as illustrated in FIG. 3. The treatment for the formation of black oxide films on the materials K is accomplished by causing this container as mounted on the roller conveyor 64 to be passed through the component chambers of the furnace proper 10 over respectively required lengths of time.

Between the component chambers and at the outlet and inlet of the furnace proper 10, there are respectively disposed first to sixth automatically operatable shutters 68, 70, 72, 74, 76, and 78. These shutters 68, 70, 72, 74, 76, and 78 are each adapted to be opened when the approach of the container 66 advanced on the roller conveyor 64 is detected by a detection device (not shown) such as a sensor. As soon as the shutter is opened, the driving speed of the roller conveyor 64 in the relevant chamber is abruptly increased so that the container 66 will be admitted into the chamber, with the possible outflow of the interior gas of that chamber repressed as much as possible.

Now, the conditions which the component chambers of the furnace proper are required to fulfil in ensuring effective use of the furnace for the formation of black oxide films on the surface of thin metal sheets will be described below.

The gas composition (volumetric ratio) of CO, $CO_2$, and steam introduced into the heating chamber 16 is desired to fall in the following range where the materials K for treatment are thin metal sheets made of Invar alloy., $$CO:CO_2:Steam = 1:5 \sim 20:30 \sim 50$$

Preferably, the gas composition falls in the following range:

$$CO:CO_2:Steam = 1:8 \sim 18:34 \sim 46$$

Where the materials K for treatment are thin metal sheets made of aluminum killed steel or rimmed steel, a mixed gas consisting of CO and $CO_2$ and not containing any steam is introduced.

As the source for the CO and $CO_2$ used in the mixed gas, the gas obtained by burning natural gas or some other similar flammable gas, proves to be suitable. The heating chamber 16 tolerates the hydrogen and other gases which inevitably leak in, the nitrogen gas which inevitably leaks in when air is used for combustion, and the oxygen of air which finds its way in while the shutter is raised and lowered. In the mixed gas, the content of the nitrogen gas is not allowed to exceed 70%, the total content of other leak gases 1%, and the content of the oxygen 2% respectively.

The gas composition (volumetric ratio) of CO and $CO_2$introduced into the cooling chamber 18, no matter whether the thin metal sheet as the material K for treatment is made of aluminum killed steel or Invar alloy, is desired to fall in the following range.

$$CO:CO_2 = 1:5 \sim 10$$

Preferably, the gas composition is in the following range.

$$CO:CO_2 = 1:6 \sim 9$$

As the source for the $O_2$ to be introduced into the cooling chamber 18, the air proves to be suitable. Where the air is used for this purpose, the amount of the air to be supplied is desired, relative to the total amount of CO and $CO_2$, to fall in the following range.

$$(CO+CO_2):Air = 1:10 \sim 30$$

Preferably, this ratio is in the following range $$(CO+CO_2):Air = 1:15 \sim 25$$

Figure 4:
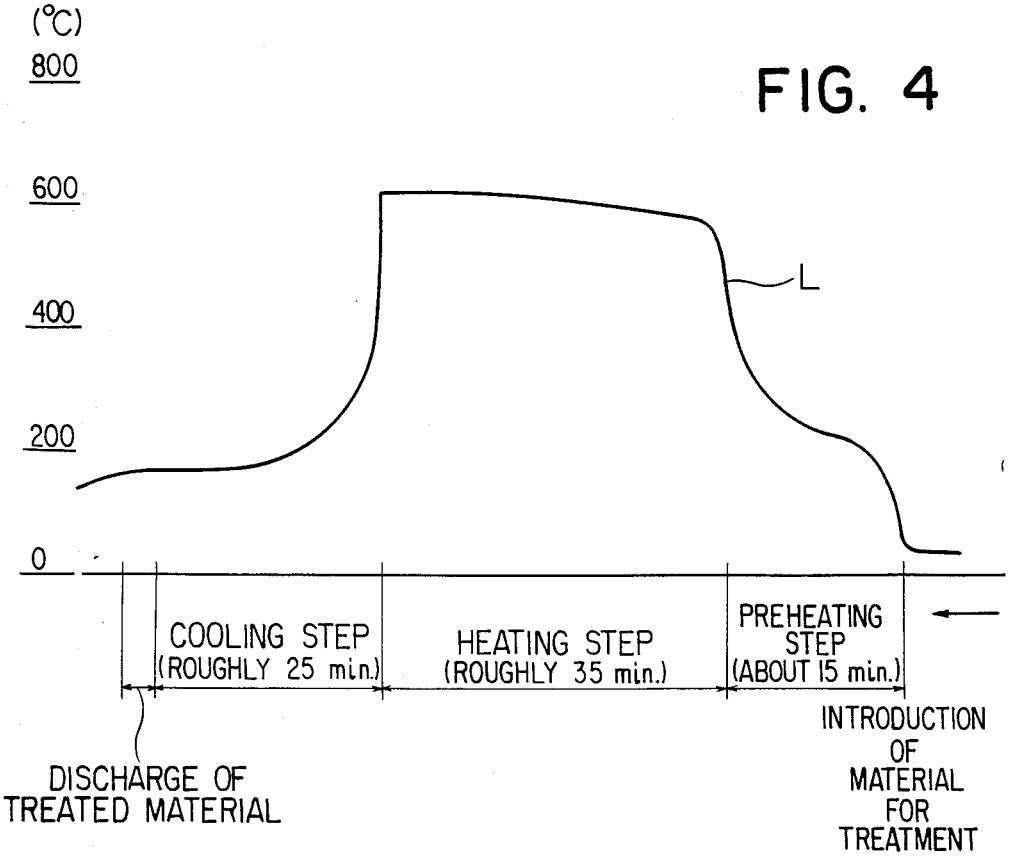
FIG. 4 is a diagram showing the process of treatments performed for the formation of a black oxide film by the use of the furnace of FIG. 1 and the change of temperature of a shadow mask material, on one time axis.

It is desirable to fix the preheating temperature of the preheating chamber 12 in the neighborhood of 200° C., the temperature of the heating chamber 16 in the range of 500° to 650° C., and the temperature of the cooling chamber 18 in the neighborhood of 200° C. Now, the operation which is involved in the formation of black oxide films on the surface of thin metal sheets made of Invar alloy or aluminum killed steel by the use of the furnace under the conditions set as described above will be explained with reference to FIG. 4.

In this diagram, L denotes a temperature change line of a thin metal sheet made of aluminum killed steel.

First, a plurality of materials K for treatment are placed in the container 66. Then, this container 66 is introduced into the furnace proper 10 from the inlet side and mounted on the roller conveyor 64. As a result, the container 60 is conveyed in the direction of the first shutter 68 of the furnace proper 10. When the approach of the container 66 is detected by the detection device, the first shutter 68 is opened and, at the same time, the portion of the roller conveyor 64 adjoining the entrance thereto is speed up to effect abrupt admission of the container 66 into the preheating chamber 12.

Inside the preheating chamber 12, the container 66 is advanced at a prescribed speed so as to preheat the materials K to a temperature in the neighborhood of 200° C. Then, the second shutter 70 is opened to admit the container 66 into the preheating purge chamber 14. Subsequently, the third shutter 72 is opened to introduce the container 66 into the heating chamber 16. The time required for the preheating treatment is about 15 minutes.

Where the materials K for treatment are thin metal sheets made of aluminum killed steel or rimmed steel, the container 66 is advanced at a prescribed speed inside the heating chamber 16 and, at the same time, the materials K are heated in the atmosphere of mixed gas containing $CO_2$and CO and containing substantially no $O_2$ at a temperature approximately in the range of 500° to 650° C. for about 35 minutes. Where the materials K for treatment are thin metal sheets made of Invar alloy, they are heated in the atmosphere of a mixed gas containing $CO_2$, CO, and steam and containing substantially no $O_2$at a temperature approximately in the range of 500° to 650° C. for about 35 minutes. In this case, when the third shutter 72 and the fourth shutter 74 are opened, the heating chamber 16 inevitably admits the ambient air, though only slightly. This leakage of the ambient air, however, has virtually no effect upon the heating treatment which proceeds in the heating chamber 16.

This treatment, particularly when the materials K for treatment are thin metal sheets made of Invar alloy, is aimed at preventing the thin metal sheets from undergoing yielding to abrupt surface oxidation by introducing the reducing gas of CO into the atmosphere of the mixed gas containing steam thereby decreasing the amount of $O_2$. In consequence of this treatment, the thermal emissivity of the produced oxide film is approximately on the order of 0.5 to 0.7, based on the thermal emissivity of the perfect blackbody taken as unity (1). The oxide film having the thermal emissivity (degree of blackness) of this level has no problem from the practical point of view.

The use of this furnace, therefore, permits a black oxide film of uniform thickness possessing high density and adhesiveness to be formed with high operational efficiency on the surface of a thin metal sheet made of aluminum killed steel, rimmed steel, or Invar alloy.

Now, the method by which a black oxide film is formed by the use of this furnace on the surface of a shadow mask material made of Invar alloy will be described below.

First, preparatory to the treatment by the use of this furnace, numerous holes for passage of electron beams are formed by the conventional photoetching method in a thin metal sheet made of Invar alloy of such composition as 36Ni-Fe. Subsequently, this thin metal sheet is annealed and stamped to be given an outer shape of desired curvature. The shaped thin metal sheet is then cleaned for removal of adhering grease.

The materials K for treatment (shadow mask materials) are set in the vertical stages inside the container 66. This container 66 is then introduced into the furnace proper 10 from the inlet side and mounted on the roller conveyor 64. The advance of the container 66 as mounted on the roller conveyor 64 through the component chambers of the furnace proper is effected in the same manner as already described.

In the process for the formation of black oxide films on the materials K under treatment by the use of this furnace, the first step consists in subjecting the materials K to roughly 13 minutes' preheating in the preheating chamber 12 which is kept at a temperature in the range of 130° to 220° C. The next step resides in advancing the container 66 to the preheating purge chamber 14, passing it through this preheating purge chamber 14 over a period of about 3 minutes, and delivering it into the heating chamber 16.

Within this heating chamber 16, the materials K are heated in the atmosphere of a mixed gas containing $CO_2$, CO, and steam at a temperature approximately in the range of 550° to 650° C. for about 35 minutes. As a result, films of $Fe_3O_4$ having a dense texture are formed on the materials K. The black oxide films processed up to this step exhibit a thermal emissivity approximately in the range of 0.3 to 0.5, based on the thermal emissivity of perfect blackbody taken as unity (1). At this point, the gas composition (volumetric ratio) of the atmosphere inside the heating chamber 16 is desired to be such that the content of $CO_2$is approximately in the range of 5 to 20 and that of steam in the range of 30 to 50 where the content of CO is taken as 1. To the treatment by the use of the furnace, the presence of $N_2$ and $H_2$ in the atmosphere does not matter.

Thereafter, the materials K are advanced to the cooling chamber 18 which is kept at a temperature approximately in the neighborhood of 200° C. When the materials K are brought into contact with the atmosphere of a mixed gas containing $CO_2$, CO, and $O_2$and kept at a temperature approximately in the neighborhood of 400° C. inside the cooling chamber 18, black oxide films of sufficient thickness possessing an amply high thermal emissivity are formed on the materials K.

In the atmosphere of this mixed gas, the materials K are cooled for about 25 minutes. The gas composition containing CO and $CO_2$ (volumetric ratio) of the atmosphere in the cooling chamber 18 is required to be such that the content of $CO_2$ is approximately in the range of 5 to 10 and that of $O_2$ in the range of 10 to 30 where the amount of CO and $CO_2$ is taken as 1. To the treatment under discussion, the presence of $N_2$, $H_2$ and $H_2O$ in the atmosphere of the mixed gas does not matter.

Thereafter, the container 66 is advanced to the cooling purge chamber 20 whose inner temperature is kept about 180° C., then passed through this cooling purge chamber 20 over a period of about 5 minutes, and finally taken out of the furnace proper 10.

In accordance with the method for production of a shadow mask described above, therefore, black oxide films of uniform thicknees possessing high density and adhesiveness can be formed with high efficiency on the materials K made of Invar alloy. The degree of blackness of the black oxide films formed by the use of the furnace is approximately in the range of 0.5 to 0.7, based on the thermal admissivity of the perfect blackbody taken as unity (1) and, therefore, is sufficient for impartation of the resistivity to doming, an indispensable requirement for the color TV picture tube.

What is claimed is:

1. A method for the formation of a black oxide film on the surface of a shadow mask material formed mainly of iron and nickel by the use of a furnace for the formation of a black oxide film on the surface of a thin metal sheet, comprising:

a heating step for heating said shadow mask material in the atmosphere of a mixed gas at a temperature in the range of 550° to 650° C., the gas containing carbon monoxide, carbon dioxide, steam, and substantially no oxygen, wherein the volumetric composition of the gas is such that the content of a carbon dioxide is in the range of 5 to 20 and the content of steam is in the range of 30 to 50, where the content of carbon monoxide is taken as 1; and a cooling step for causing said shadow mask material heated in said heating step to be cooled in the atmosphere of a mixed gas at a temperature in the range of 200° to 300° C., the gas containing carbon monoxide, carbon dioxide, oxygen, and substantially no steam, wherein the volumetric composition of the gas is such that the content of a carbon dioxide is in the range of 5 to 10, where the content of carbon monoxide is taken as 1.

2. The method according to claim 1, which further comprises a preheating step for preheating said shadow mask material at a temperature in the range of 130° to 220° C. prior to said heating step.

3. The method according to claim 1, wherein air is used as the component of oxygen to be used in said cooling step and the amount of said air is in the range of 10 to 30, based on the total volume, taken as 1, of carbon monoxide and carbon dioxide to be simultaneously used in said cooling step.

* * * * *